US005301439A

United States Patent [19]

Wang

[11] Patent Number: 5,301,439

[45] Date of Patent: Apr. 12, 1994

[54] DESICCANT ROTOR OF A DEHUMIDIFIER

[76] Inventor: Bang-Chih Wang, 58, Ma Yuan West St., Taichung, Taiwan

[21] Appl. No.: 974,275

[22] Filed: Nov. 10, 1992

[51] Int. Cl.[5] ..... F26B 21/06

[52] U.S. Cl. ..... 96/125; 34/9; 34/80; 62/94

[58] Field of Search ..... 34/69, 71, 72, 74, 76, 34/77-82, 95, 9, 27, 32; 55/34, 180, 390; 62/94

[56] References Cited

U.S. PATENT DOCUMENTS 2,993,563 7/1961 Munters et al. ..... 183/4.6
3,446,031 5/1969 Chi et al. ..... 62/94
3,880,224 4/1975 Weil ..... 62/94
4,134,743 1/1979 Macriss et al. ..... 55/34
4,701,189 10/1987 Oliker ..... 55/34

*Primary Examiner*—Henry A. Bennett
*Assistant Examiner*—Denise Gromada

[57] ABSTRACT

A desiccant rotor including three or more barrels rotatably disposed in a housing, each of the barrels having a passage formed in a center portion and made of screen material and having one end for receiving air, and a stop disposed in a middle portion of the passage for preventing the air from directly flowing out of the barrel. A rotating mechanism is disposed below the housing for rotating the barrels relative to the housing.

5 Claims, 8 Drawing Sheets

DESICCANT ROTOR OF A DEHUMIDIFIER

BACKGROUND OF THE INVENTION (a) Field of the Invention

The present invention relates to a desiccant rotor, and more particularly to a desiccant rotor of a dehumidifier.

(b) Description of the Prior Art

Plastic particles are molten before the plastic materials can be injected and molded, however, the plastic particles should be dried before the melting processes. A typical dehumidifier for dehumidifying the plastic particles is shown in FIG. 7 and comprises a desiccant rotor 90 for supplying dehumidified air into a hopper dryer 91 in which plastic particles are contained. It is preferable that the air is preheated by a heater 92 before entering into the hopper dryer 91. The air flown out from the hopper dryer 91 flows through a filter 93 and an air cooler 94 and is pumped into the dehumidifying areas of the desiccant rotor 90 by a blower 95, part of the air flown out of the hopper dryer 91 flows through a filter 93 and an air cooler 94 and is pumped into the cooling areas of the desiccant rotor 90 by the blower 95. A pump 97 also pumps air into the regeneration areas of the desiccant rotor 90 and the air is preheated by a heater 98 before entering into the regeneration areas of the desiccant rotor 90, such that a heated air is pumped into the regeneration areas of the desiccant rotor 90 in order to draw the humidity from the desiccant of the desiccant rotor 90.

A typical desiccant rotor 90 is shown in FIG. 8 and comprises a cylindrical housing 80 rotatably engaged between a cap 81 and a base 82, two plates 83, 84 engaged on the upper portion of the housing 80 and two boards 85, 86 engaged on the lower portion of the housing 80, a shaft 87 rotatably engaged between the cap 81 and the base 82 and having three blades 88 fixed thereon. The base 82 includes three inlets 89 formed therein such that air can be supplied into the housing 80 of the desiccant rotor 90, the air then flows out of the housing 80 via the cap 81. In this type of single desiccant rotor 90, the interior thereof is divided into three areas which require different temperatures, however, the temperature of the areas will be interfered with one another such that the air can not be suitably dehumidified.

The present invention has arisen to mitigate and/or obviate the afore-described disadvantages of the conventional desiccant rotors of the dehumidifiers.

SUMMARY OF THE INVENTION

The primary objective of the present invention is to provide a desiccant rotor of a dehumidifier in which air can be suitably dehumidified.

In accordance with one aspect of the present invention, there is provided a desiccant rotor comprising a housing rotatably engaged between a cap and a base, at least one plate engaged on one end of the housing, at least one board engaged on the other end of the housing, and at least three barrels, or so-called desiccant sub-rotors or desiccant bed, engaged between the plate and the board, each of the barrels including a passage formed in a center portion thereof and made of screen material and having one end for receiving air, and a stop disposed in a middle portion of the passage for preventing the air from directly flowing out of the barrel. A rotating mechanism is disposed on the lower portion of the base for rotating the barrels relative to the housing and the base.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
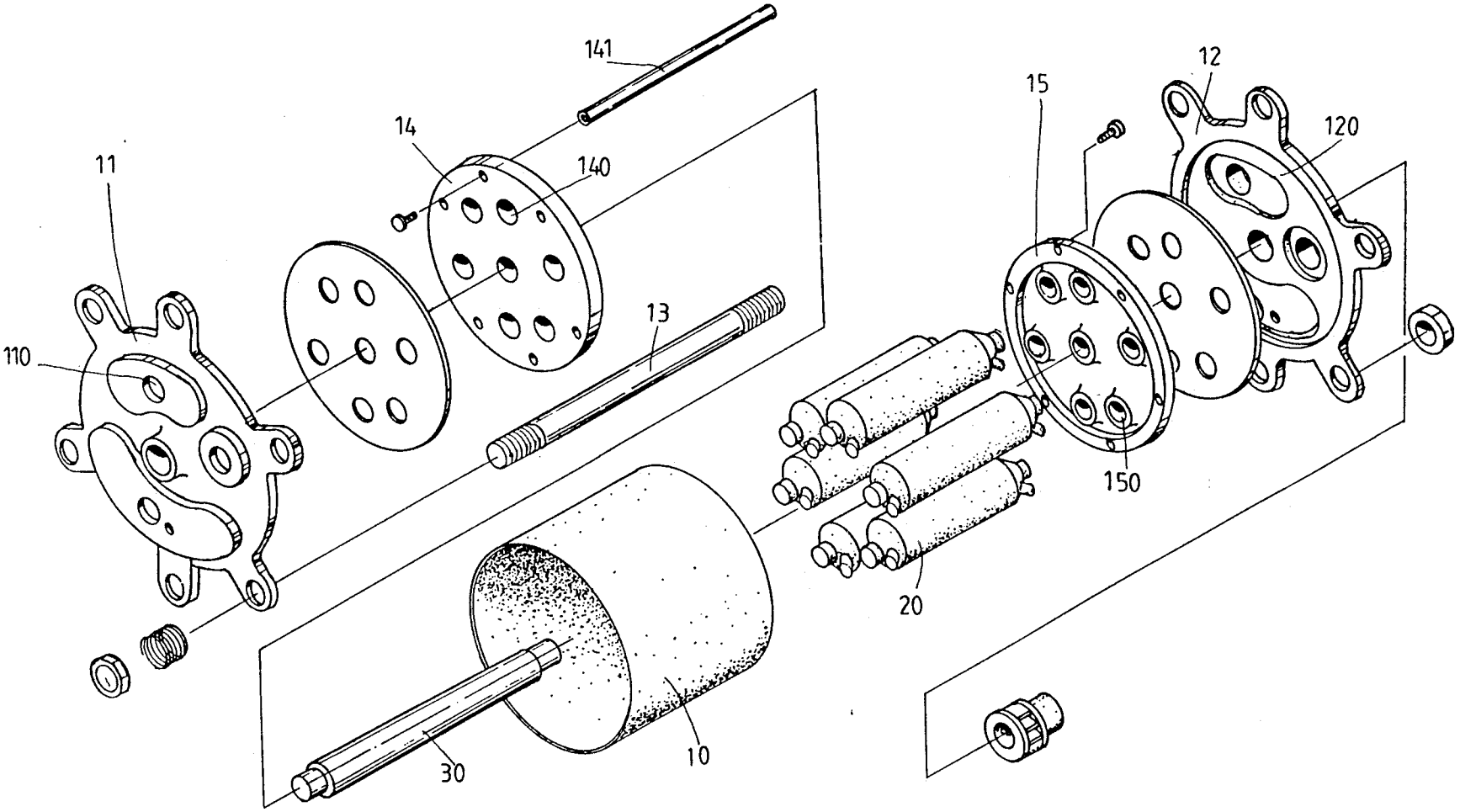
FIG. 1 is a partial exploded view of a desiccant rotor of a dehumidifier in accordance with the present invention.
Figure 2:
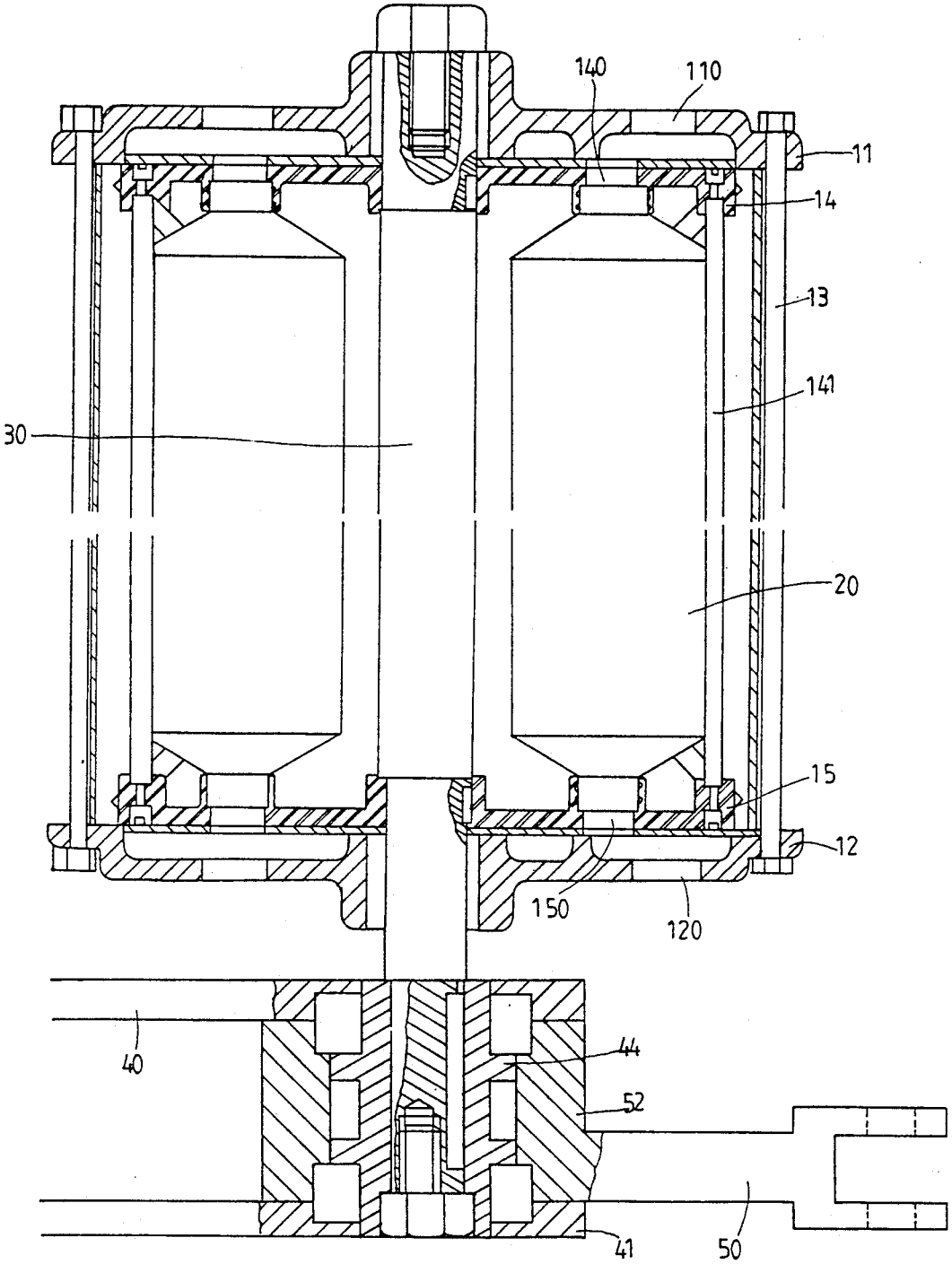
FIG. 2 is a cross sectional view of the desiccant rotor.
Figure 3:
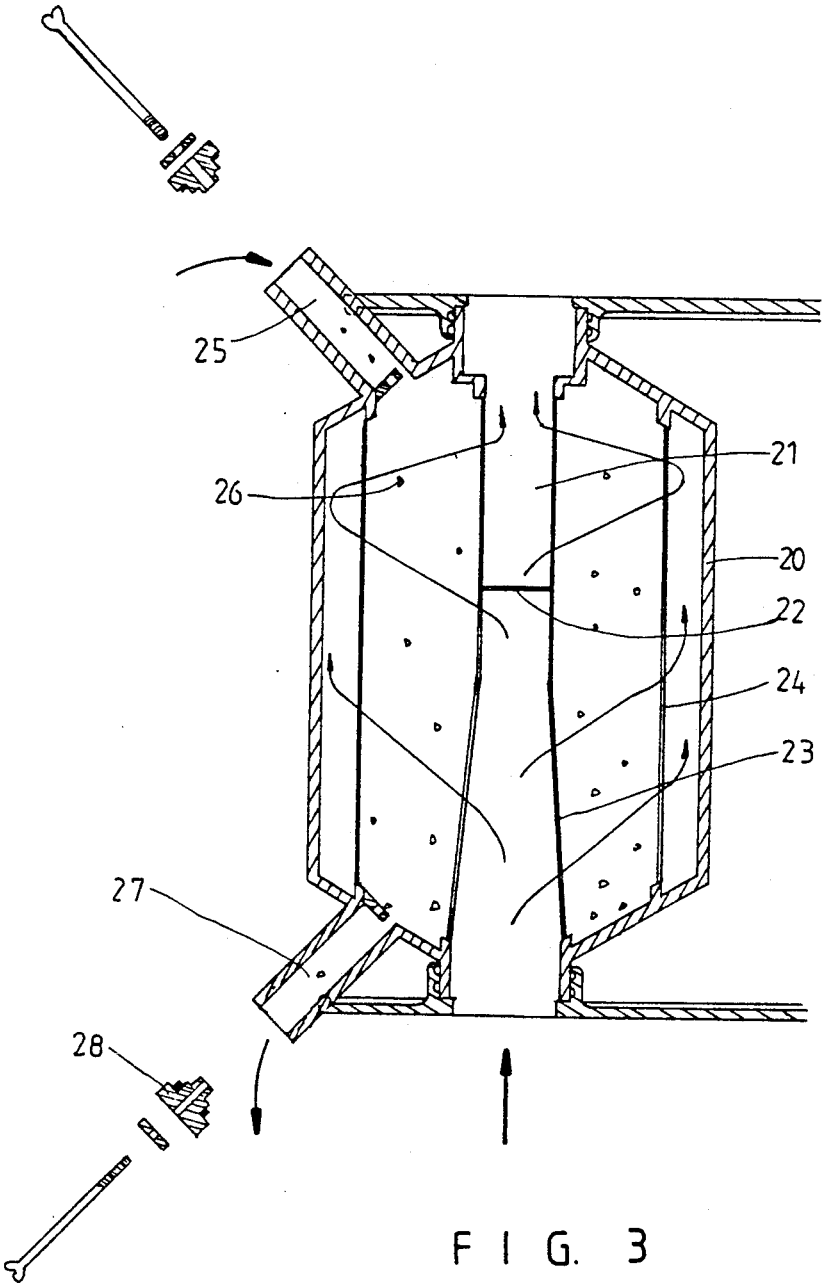
FIG. 3 is a cross sectional view of one of the barrels.

Referring to the drawings and initially to FIGS. 1, 2 and 3, a desiccant rotor in accordance with the present invention comprises generally a cylindrical housing 10 rotatably disposed between a cap 11 and a base 12 which are fixed together by bolts 13, at least one plate 14 fixed on the upper portion of the housing 10, at least one board 15 fixed on the lower portion of the housing 10, the plate 14 and the board 15 being fixed together by bolts 141, and six barrels 20 disposed between the plate 14 and the board 15. The barrels 20 are so-called desiccant sub-rotors or desiccant bed and are communicated with the holes 140, 150 of the plate 14 and the board 15. The base 12 includes three apertures 120 formed therein such that air may flow into the barrels 20, and the cap 11 includes three orifices 110 formed therein such that air may flow out of the housing 10 via the orifices. A shaft 30 is rotatably engaged between the cap 11 and the base 12 and coupled to the plate 14 and the board 15 such that the plate 14, the board 15, the barrels 20 and the shaft 30 rotate in concert. The shaft 30 has a lower end extended downward through the base 12 for engagement with a rotating mechanism which will be discussed later.

As shown in FIG. 3, each of the barrels 20 includes a passage 21 longitudinally formed in the center thereof and having a stop 22 formed integral on the middle portion thereof, and a cylindrical drum 24 formed between the passage 21 and the body of the barrel 20, the passage 21 and the drum 24 are formed by screen and mesh materials such that air may flow therethrough, however, it is to be noted that the stop 22 is made of solid materials and has no holes formed therein such that air may not flow through the stop 22. An inlet 25 is formed in the upper portion of the barrel 20 for inserting the desiccant materials 26 into the barrel 20; accordingly, the air flown into the barrel 20 via the lower portion thereof is prevented from directly flowing out of the barrel 20 by the stop 22, such that the air may be maintained in the barrel 20 for a longer period of time and such that the air may be suitably contacted with the desiccant materials 26 and can be suitably dehumidified. An outlet 27 is preferably provided in the lower portion of the barrel 20 for discharging the desiccant materials contained therein and is enclosed by a plug 28.

Figure 4:
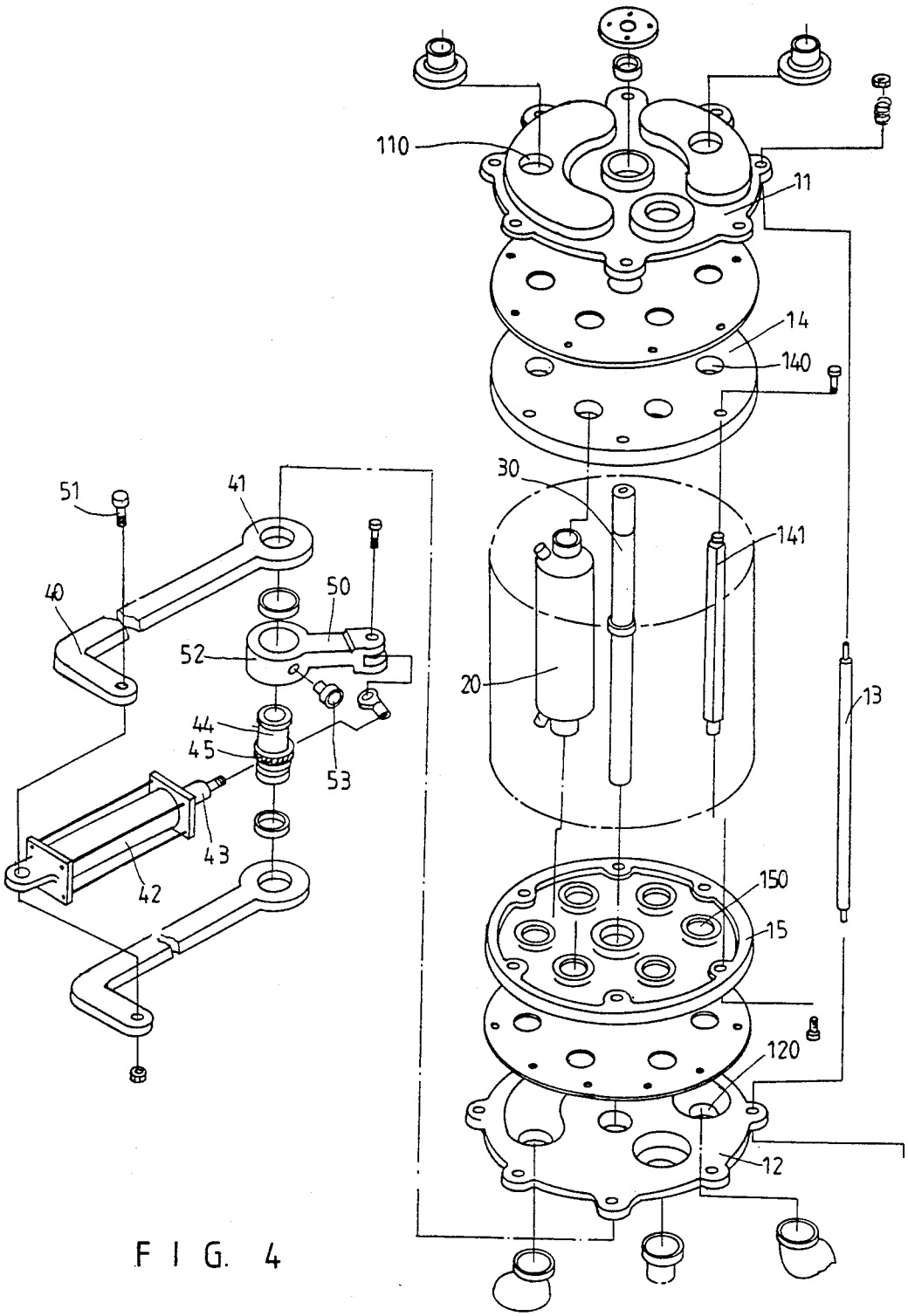
FIG. 4 is an exploded view of the desiccant rotor.
Figure 5:
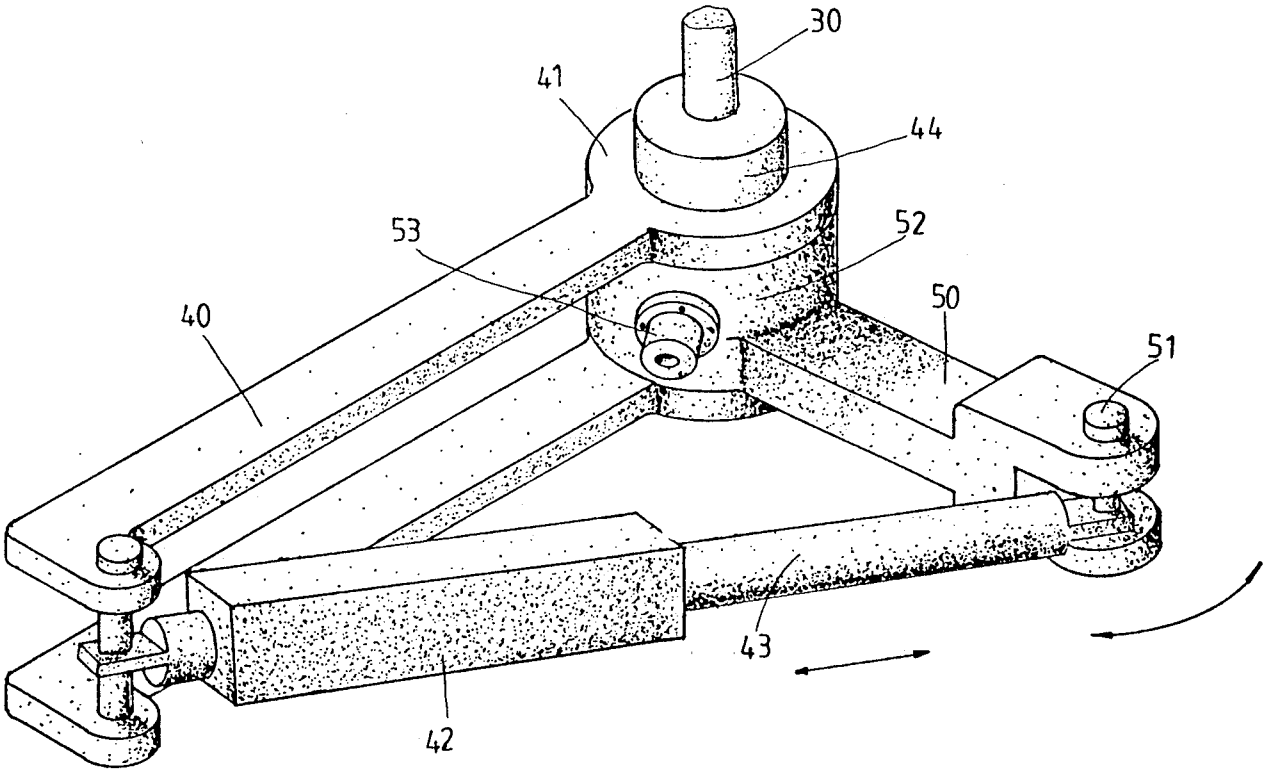
FIG. 5 is a perspective view illustrating part of the rotating mechanism of the desiccant rotor.

Referring next to FIGS. 4 to 6, and again to FIG. 2, the rotating mechanism includes a pair of beams 40 each having a ring 41 formed integral on one end thereof and having the other ends pivotally coupled to an actuator 42 which includes a piston rod 43, a stub 44 rotatably engaged between the rings 41 of the beams 40 and including a ratchet gear 45 formed in the middle portion thereof, and a lever 50 including a first end pivotally coupled to the piston rod 43 by a bolt 51 and a sleeve 52 formed integral on the second end thereof and rotatably engaged on the stub 44, and a casing 53 fixed to the sleeve 52 and including a pin 54 slidably engaged therein and biased by a spring element 55 to engage with the ratchet gear 45 of the stub 44. As best shown in FIG. 2, the lower end of the shaft 30 extends into the stub 44 and is coupled to the stub 44, such that the shaft 30 and the barrels 20 rotate in concert with the stub 44.

Figure 6:
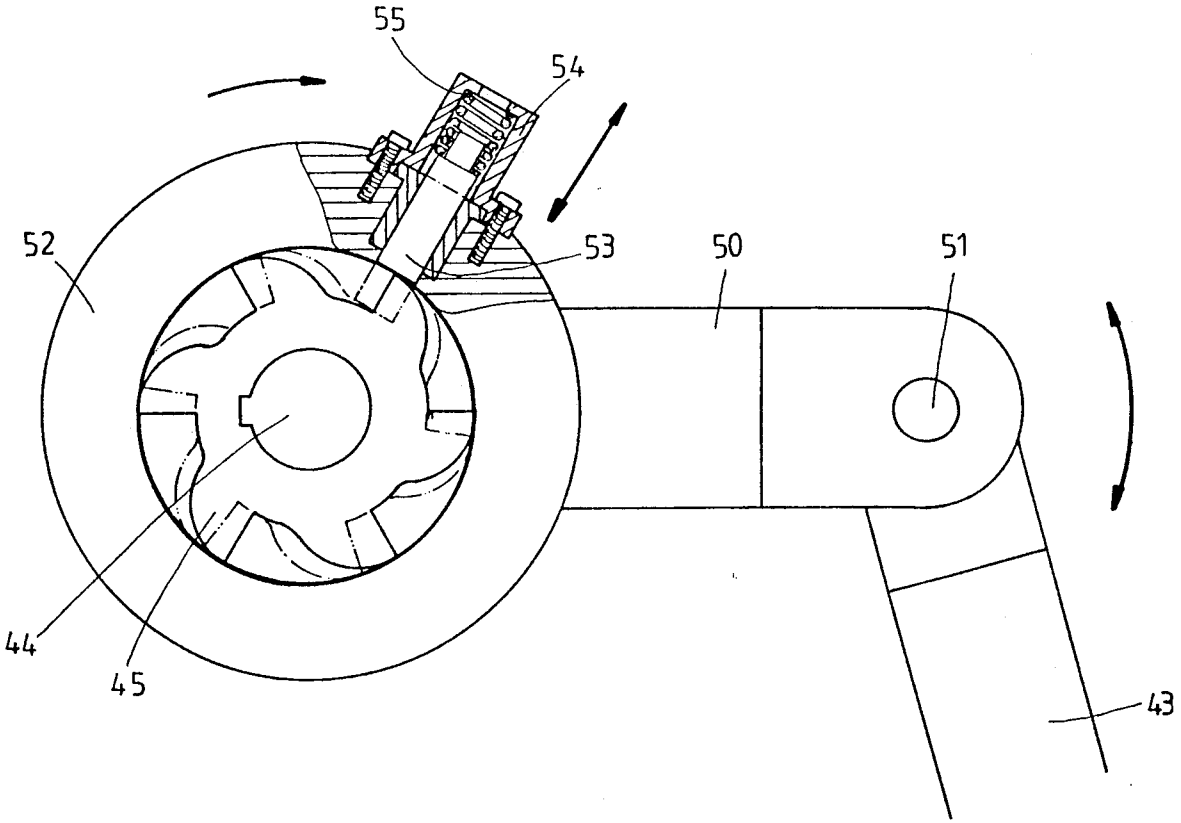
FIG. 6 is a schematic view illustrating the operation of the rotating mechanism.
Figure 7:
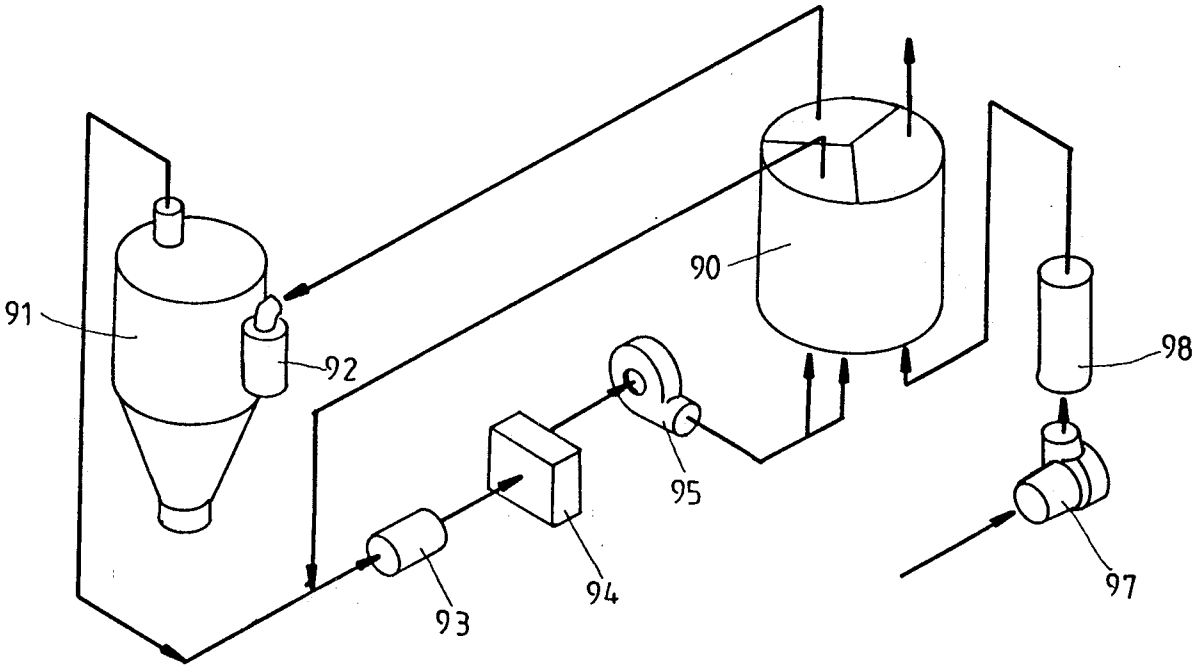
FIG. 7 is a schematic view illustrating the dehumidifying system for plastic particles.
Figure 8:
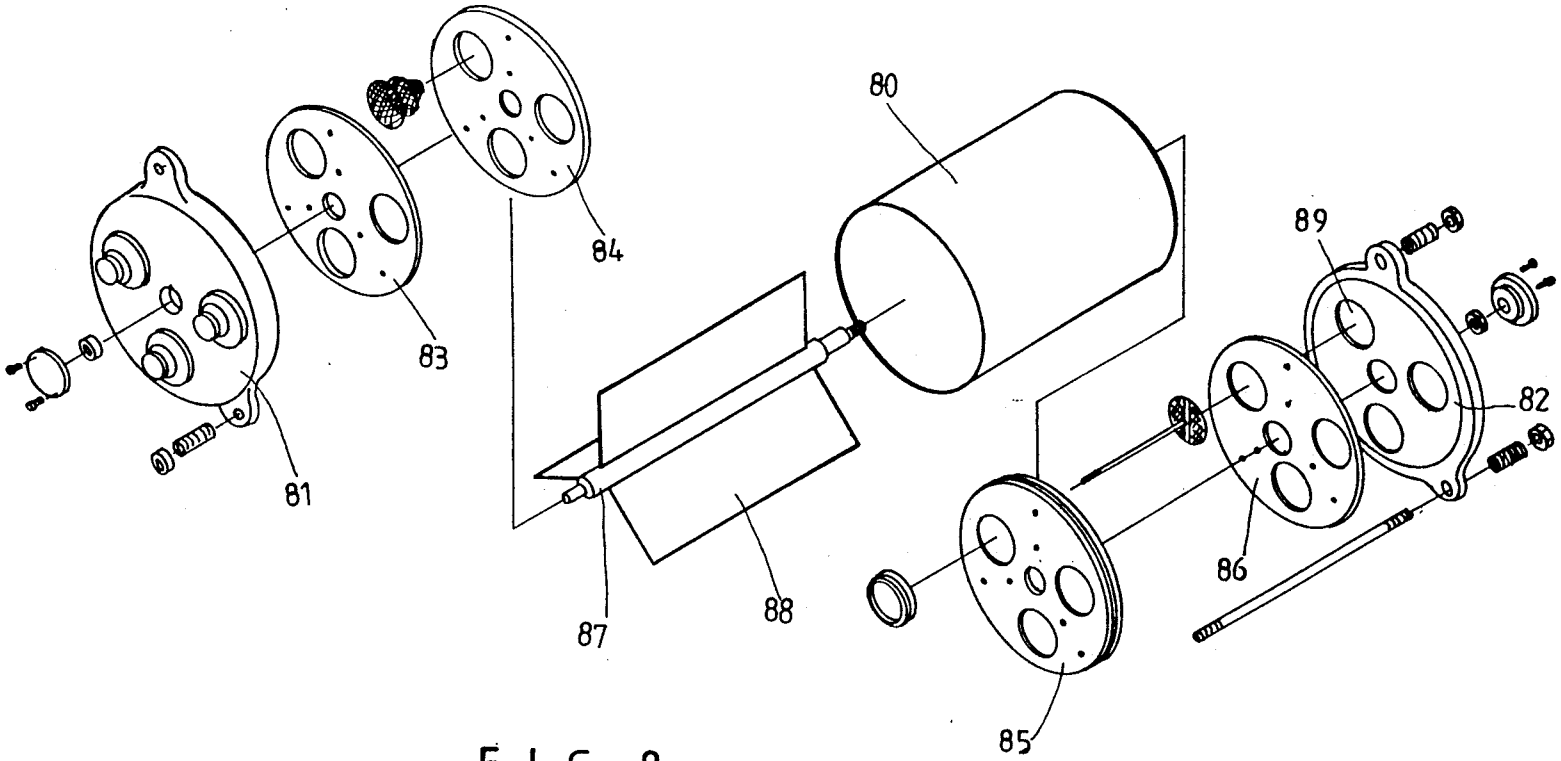
FIG. 8 is an exploded view of a typical desiccant rotor.

As best shown in FIG. 6, when the sleeve 52 is rotated counter-clockwise by the actuator 42, the pin 54 slides along the outer surface of the tooth of the ratchet gear 45 and is biased to engage in the void between the teeth by the spring 55. However, when the sleeve 52 is rotated clockwise, the ratchet gear 45 and the stub 44 and thus the shaft 30 and the barrels 20 can be rotated clockwise with respective to the housing 10. Accordingly, the barrels 20 can be rotated for 60 degrees each time such that two sets of three barrels 20 may be communicated with the apertures 120 of the base 12 alternatively.

It is to be noted that the barrels 20 are arranged to be rotated for 120 degrees each time if only three barrels 20 are disposed in the desiccant rotor.

Accordingly, air can be suitably dehumidified in the barrels of the desiccant rotor in accordance with the present invention, and the barrels can be rotated by a rotating mechanism.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A desiccant rotor comprising a housing rotatably engaged between a cap and a base, at least one plate engaged on one end of said housing, at least one board engaged on the other end of said housing, and at least three barrels engaged between said plate and said board, each of said barrels including a passage formed in a center portion thereof and made of screen material and having one end for receiving air, a stop disposed in a middle portion of said passage for preventing said air from directly flowing out of said barrel, a shaft rotatably engaged between said cap and said base and coupled to said plate and said board such that said shaft rotates in concert with said barrels, said shaft including a first end extended outward through said board, and a rotating mechanism including at least one beam having a ring formed integral on a first end thereof, an actuator pivotally coupled to a second end of said beam, and having a piston rod, a stub rotatably engaged in said ring and having a ratchet gear formed thereon, said first end of said shaft coupled to said stub and rotated in concert with said stub, a lever having a first end pivotally coupled to said piston rod of said actuator and having a sleeve formed on a second end thereof and rotatably engaged on said stub, a pin disposed in said sleeve, and means for biasing said pin to engage with said ratchet gear, whereby, said shaft and said barrels are rotated when said sleeve is rotated relative to said stub by said actuator.

2. A desiccant rotor according to claim 1, wherein said sleeve includes a casing fixed therein, said pin and said biasing means are disposed in said casing, and said pin is biased by said biasing means to engage with said ratchet gear.

3. A desiccant rotor comprising a housing rotatably engaged between a cap and a base, at least one plate engaged on one end of said housing, at least one board engaged on the other end of said housing, and at least three barrels engaged between said plate and said board, a shaft rotatably engaged between said cap and said base and coupled to said plate and said board such that said shaft rotates in concert with said barrels, said shaft including a first end extended outward through said board, and a rotating mechanism including at least one beam having a ring formed integral on a first end thereof, an actuator pivotally coupled to a second end of said beam, and having a piston rod, a stub rotatably engaged in said ring and having a ratchet gear formed thereon, said first end of said shaft coupled to said stub and rotated in concert with said stub, a lever having a first end pivotally coupled to said piston rod of said actuator and having a sleeve formed on a second end thereof and rotatably engaged on said stub, a pin disposed in said sleeve, and means for biasing said pin to engage with said ratchet gear, whereby, said shaft and said barrels are rotated when said sleeve is rotated relative to said stub by said actuator.

4. A desiccant rotor according to claim 3, wherein said sleeve includes a casing fixed therein, said pin and said biasing means are disposed in said casing, and said pin is biased by said biasing means to engage with said ratchet gear.

5. A desiccant rotor according to claim 3, wherein each of said barrels includes a passage formed in a center portion thereof and made of screen material and having one end for receiving air, and a stop disposed in a middle portion of said passage for preventing said air from directly flowing out of said barrel.

* * * * *